US007946085B2

(12) United States Patent
Prins

(10) Patent No.: US 7,946,085 B2
(45) Date of Patent: May 24, 2011

(54) STAIR STRINGER ASSEMBLY

(75) Inventor: Michael Henry Prins, Hudsonville, MI (US)

(73) Assignee: MPI Concepts, Inc., Hudsonville, MI (US)

( * ) Notice: Subject to any disclaimer, the term of this patent is extended or adjusted under 35 U.S.C. 154(b) by 462 days.

(21) Appl. No.: 12/033,492

(22) Filed: Feb. 19, 2008

(65) Prior Publication Data

US 2009/0205267 A1 Aug. 20, 2009

(51) Int. Cl.
*E04F 11/00* (2006.01)
*E04F 19/10* (2006.01)

(52) U.S. Cl. ..... 52/191; 52/188

(58) Field of Classification Search ..... 52/182, 52/183, 184, 185, 187, 191, 105, 127.2, 127.7, 52/188; 248/207
See application file for complete search history.

(56) References Cited

U.S. PATENT DOCUMENTS

| | | | | | |
|---|---|---|---|---|---|
| 2,021,457 | A * | 11/1935 | Mackenzie | ..... | 52/191 |
| 3,596,941 | A | 8/1971 | Tracy | | |
| 4,422,270 | A * | 12/1983 | Lapointe et al. | ..... | 52/182 |
| 4,866,894 | A * | 9/1989 | Brown | ..... | 52/182 |
| 5,899,032 | A * | 5/1999 | Buzby | ..... | 52/182 |
| 6,088,977 | A * | 7/2000 | Lawrence | ..... | 52/182 |
| 6,758,016 | B2 * | 7/2004 | Gobeil | ..... | 52/191 |
| 7,162,805 | B2 * | 1/2007 | Vick | ..... | 33/42 |
| 2003/0208971 | A1 * | 11/2003 | Couture | ..... | 52/182 |
| 2009/0235594 | A1 * | 9/2009 | Won | ..... | 52/179 |

FOREIGN PATENT DOCUMENTS

| | | |
|---|---|---|
| DE | 1659581 | 1/1971 |
| WO | 03076738 | 9/2003 |

OTHER PUBLICATIONS

International Search Report, Written Opinion of the International Searching Authority, mailed May 28, 2009.

* cited by examiner

*Primary Examiner* — Eileen Lillis
*Assistant Examiner* — Theodore Adamos
(74) *Attorney, Agent, or Firm* — Warner Norcross & Judd LLP

(57) ABSTRACT

A stringer assembly includes a support element, a plurality of brackets and a plurality of alignment elements. The brackets are connected to the support element, and each bracket includes a rise indicator corresponding to a desired rise dimension and a run indicator corresponding to a desired run dimension. The alignment elements align the rise or run indicator on one of the brackets with the other of the rise or run indicator on an adjacent one of the brackets to space the brackets at a desired rise and run. The brackets each include a tread flange and a riser flange, such that a tread and a riser can be directly connected to each bracket. The brackets may include cutouts for a temporary tread system.

13 Claims, 7 Drawing Sheets

STAIR STRINGER ASSEMBLY

BACKGROUND OF THE INVENTION

The present invention relates to stair stringers, and more particularly to an assembly for constructing a stair stringer assembly and a stairway assembly.

Conventional stairways, especially in residential construction, include a stringer made from a 2×12 piece of wood, with portions of the stringer cut away to define the rise and run of each step. This construction requires that each triangular portion of wood removed be marked and cut separately, involving a great deal of labor and presenting numerous opportunities for error and injury—even for the most skilled carpenter. It also results in a stringer having an effective structural thickness of less than half the thickness of the original 2×12 piece of lumber, with about one-quarter of the original 2×12 piece being scrapped.

A number of attempts have been made at producing stairs more efficiently and accurately. Most of these attempts incorporate preassembled portions of stringers, portions of stairways, or complete prefabricated stairways. These products reduce some of the on-the-job calculating and cutting that is required with conventional stringers, but they also reduce, and in some cases eliminate, the ability of the installer to accommodate for variables found in the typical building environment, such as variations in the floor to ceiling height and variations in the tread and riser materials.

U.S. Pat. No. 6,088,977 discloses a plurality of L-shaped brackets that can be used to construct a stringer. Each L-shaped bracket includes markings to indicate rise and run dimensions. The stringer is constructed by separately aligning and attaching each individual bracket onto a conventional 2×6 board using the bracket's rise and run dimensions. Treads and risers are attached to the stringers to complete the stairway. This system eliminates most of the cutting issues in constructing the stringer, but suffers from disadvantages as each bracket must be carefully measured before attaching it to the 2×6 board, which increases installation time and leaves a significant potential for error in the placement of each bracket. As a result, stairway manufacturers, contractors and do-it-yourself installers are continually searching for a simple, efficient and accurate way to construct stairway stringers and stairways.

SUMMARY OF THE INVENTION

The present invention provides an assembly for accurately and efficiently constructing a stringer assembly and a stairway assembly, while providing variability during installation.

In one embodiment, the stringer assembly includes a support element, a plurality of brackets and a plurality of alignment elements. The support element may be a generally straight, structural piece, such as a 2×4. The brackets are connected to the support element, and each bracket includes a rise indicator corresponding to a desired rise dimension and a run indicator corresponding to a desired run dimension. The alignment elements register the brackets by aligning the rise indicator on each of the brackets with a run indicator on an adjacent one of the brackets to space the brackets at a desired rise and run and to square the brackets at the proper angles. The brackets each include a tread flange and a riser flange, such that a tread and a riser can be directly connected to each bracket.

In one embodiment, the bracket includes a body, tread and riser flanges extending from the body, and at least one of a rise indicator and a run indicator on the body. Each rise indicator and run indicator is positioned such that a run indicator on one bracket can be aligned with a rise indicator on a second bracket. When the brackets are aligned in this manner, they space apart the tread flange on the one bracket from the tread flange on the second bracket at a desired rise dimension and a desired run dimension. Additional brackets may be similarly aligned and attached together to form the stringer assembly. The rise indicators and run indicators may be holes defined in the body of the bracket, and in one embodiment the bracket includes a plurality of rise indicator holes and a plurality of run indicator holes, each corresponding to a desired rise dimension or a desired run dimension. The assembly may further include a head bracket capable of being attached to the ceiling and having a rise indicator and a foot bracket capable of being attached to the floor and having a run indicator. Finally, each bracket may also include a plurality of attachment holes for securing the bracket to the support element and thus transferring loads to the support element.

In another embodiment, the assembly includes a temporary tread system, wherein the bracket body includes a cutout that is sized to receive a temporary tread support. A safe and solid temporary tread can be attached to the temporary tread support for use by installers and workers during construction before the finished tread is installed on the tread flanges. In one embodiment, the body includes a cutout shaped to receive a 2×4, and the cutout is spaced from the tread flange on the bracket such that the finished tread can be attached to the tread flange without removing the temporary tread. In a stairway assembly with multiple stringers, the temporary tread support can be inserted through each stringer, and the temporary tread can be glued, nailed, screwed or otherwise attached to the temporary tread support. In addition, in one embodiment, the temporary tread support can extend through and beyond the brackets to rest on a vertical support post to aid in transferring stair loads.

In yet another embodiment, the assembly includes a preassembled tread and riser combination that can be attached to the bracket as a single piece. The riser or tread includes a notch to securely receive an end of the other piece. The tread piece attaches to the tread flange of a first bracket and the riser attaches to the riser flange of a second bracket.

The present invention provides an accurate way to create and assemble a stringer, while providing a high degree of variability to accommodate for different rises and runs, as well as normal construction variables. The rise and run indicator holes are easily aligned to provide the desired rise and run spacing while also registering each bracket with the adjacent brackets. The tread and riser flanges enable a direct connection with the treads and risers, and the temporary tread cutout allows installers to easily assemble temporary treads, without requiring additional labor to remove or replace the temporary treads before installing the finished treads. In addition, the tread and riser system securely supports the loads of the entire length of the back of the tread, which in some cases may eliminate the need for a middle stringer.

These and other objects, advantages, and features of the invention will be readily understood and appreciated by reference to the detailed description of the current embodiment and the drawings.

DETAILED DESCRIPTION OF THE CURRENT EMBODIMENTS

I. Overview

Figure 1:
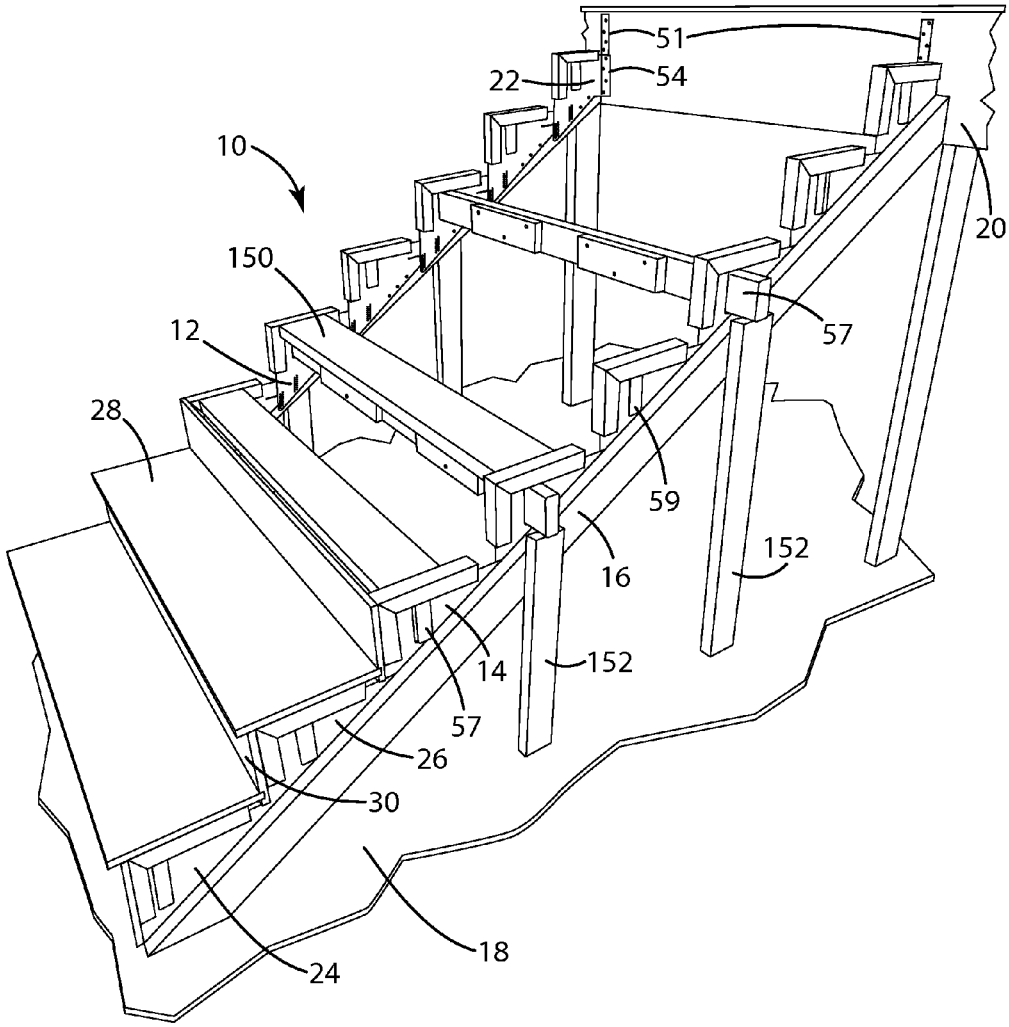
FIG. 1 is a perspective view of a stringer and stairway assembly according to a first embodiment of the present invention.
Figure 2:
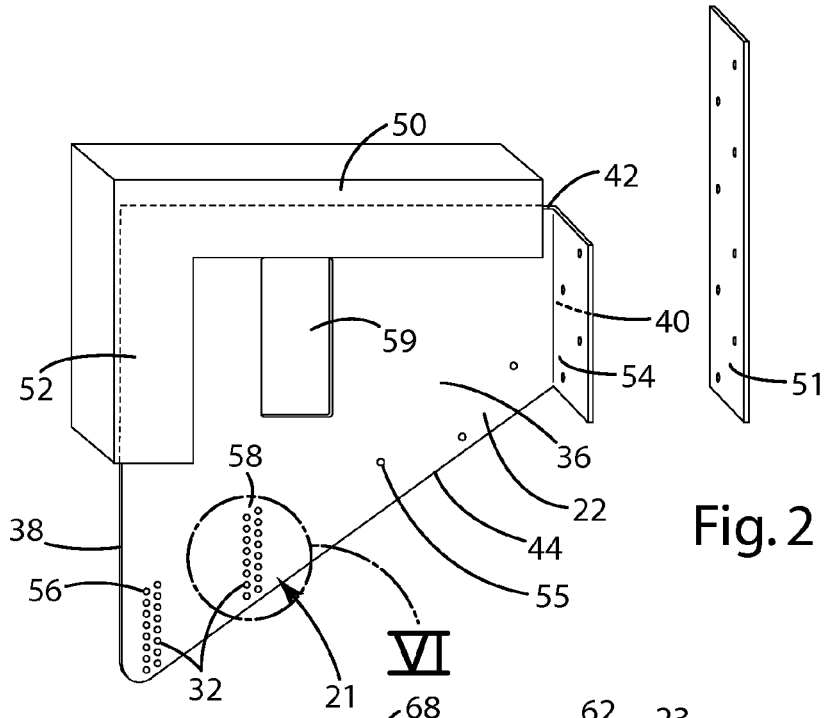
FIG. 2 is a perspective view of a head bracket according to the first embodiment.
Figure 3:
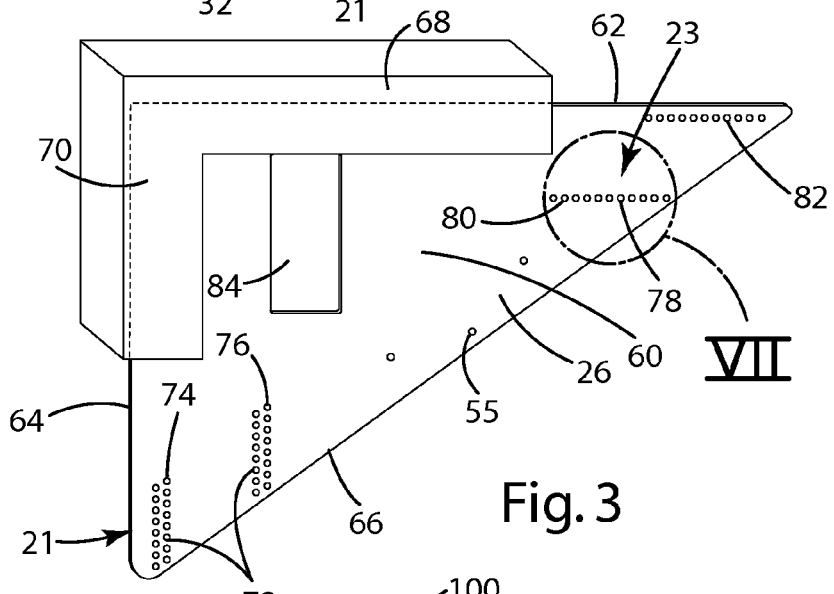
FIG. 3 is a perspective view of a center bracket according to the first embodiment.
Figure 4:
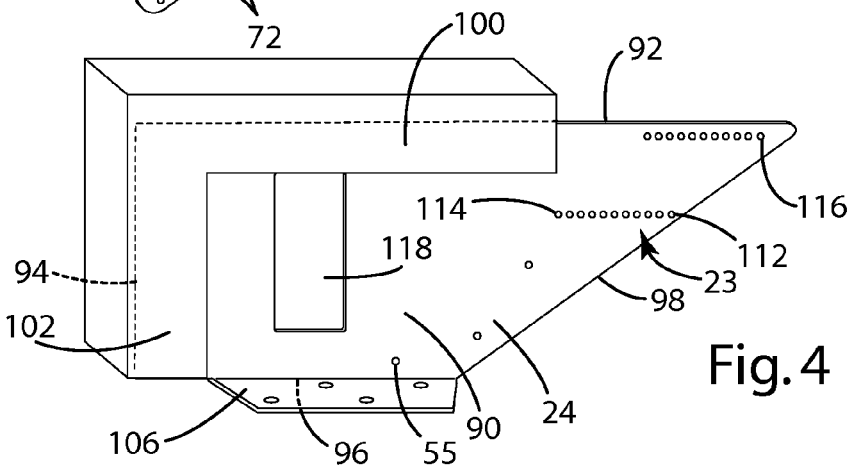
FIG. 4 is a perspective view of a foot bracket according to the first embodiment.
Figure 5:
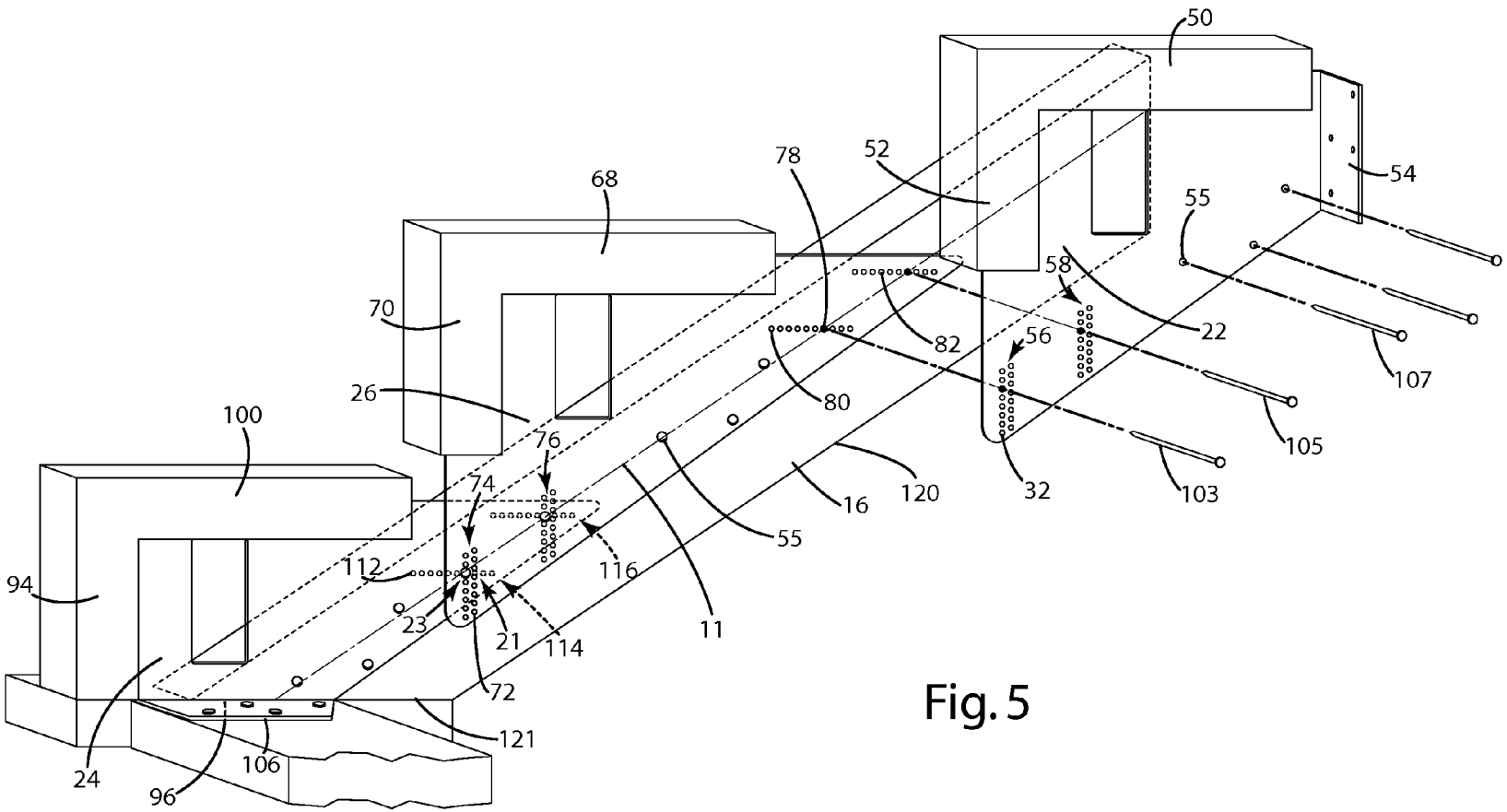
FIG. 5 is a perspective view of the stringer bracket assembly according to the first embodiment, with one of the brackets shown in an exploded view.

A stair stringer assembly according to one embodiment of the present invention is shown in FIG. 1 and is generally designated 10. As shown, the assembly 10 includes a left stringer assembly 12 and a right stringer assembly 14. The stringer assemblies are each attached to a support board 16 that extends from the floor 18 to the upper floor structure 20. In one embodiment, each stringer assembly 12, 14 includes a plurality of brackets, including a head bracket 22, a foot bracket 24 and a plurality of center brackets 26. Each pair of brackets on opposing left 12 and right 14 stringer assemblies supports a tread 28 and a riser 30. As shown in FIGS. 2-4, the brackets 22, 24 and 26 each include at least one rise indicator 21 or run indicator 23. As shown in FIG. 5, the rise indicator 21 of a first bracket can be aligned with a run indicator 23 of a second bracket to attach the brackets to the support board 16 with a desired rise and run between the treads 28 and risers 30 on each bracket.

II. Structure

As noted above, in one embodiment, the stairway assembly 10 includes two stringer assemblies 12 and 14. The left stringer assembly 12 supports the left side of the stairway 10 and the right stringer assembly 14 supports the right side of the stairway 10. In another, embodiment, the stairway 10 may include additional stringer assemblies as necessary to provide sufficient support for the stairway 10. For instance, a third stringer assembly may be included to support the center of the stairway. The third stringer assembly may be a left stringer assembly, a right stringer assembly or a different central stringer assembly.

FIGS. 2-4 show close-up views of the brackets 22, 24 and 26 of the left stringer assembly 12. In the illustrated embodiment, these brackets are mirror images of the brackets of the right stringer assembly; therefore, only the left set will be described in detail. The brackets made be formed from a variety of materials, for example, they made be made from sheet steel, aluminum, or another alloy or composite material. The bracket materials made be formed from a variety of processes, including stamping or molding.

Referring now to FIG. 2, in one embodiment, the head bracket 22 includes a generally planar body 36 having a front edge 38, a rear edge 40, a top edge 42 and a bottom edge 44. As shown, the top edge 42 is generally perpendicular to the front edge 38 and the rear edge 40. The front edge 38 is longer than the rear edge 40, and the bottom edge 44 angles from the front edge 38 to the rear edge 40. The head bracket 22 additionally includes a tread flange 50, a riser flange 52 and a support flange 54. In the illustrated embodiment, the tread flange 50 and riser flange 52 are separate pieces that are attached to the top 42 and front 38 edges by a conventional method, such as a plurality of sharp, nail-like projections (not shown) that extend from the bracket 22 into the flanges 50, 52, or other adhesives, fasteners or both. The tread 50 and riser 52 flanges may be formed from laminated wood, or they may alternatively be formed from a variety of other conventional materials. In one embodiment, the tread flange 50 has a length that is approximately the same size or shorter than the shortest conventional stairway run, for example, about 9 inches or less. As illustrated, the support flange 54 is formed with the body 36 as a single piece and bent approximately at a right angle to the body 36. The support flange 54 may include a plurality of holes that are capable of receiving fasteners for attaching the support flange to the upper floor structure 20. In one embodiment, shown in FIGS. 1, 2 and 12 an additional support bracket 51 may be provided. The support bracket 51 may be taller than the support flange 54, such that it extends above the support flange and the top edge 42 of the bracket to provide extra material for attaching the support flange 54 and the bracket 22 to the upper floor structure 20. In an alternative embodiment, the support flange 54 itself may be elongated to extend above the top edge 42 of the bracket.

Figure 6:
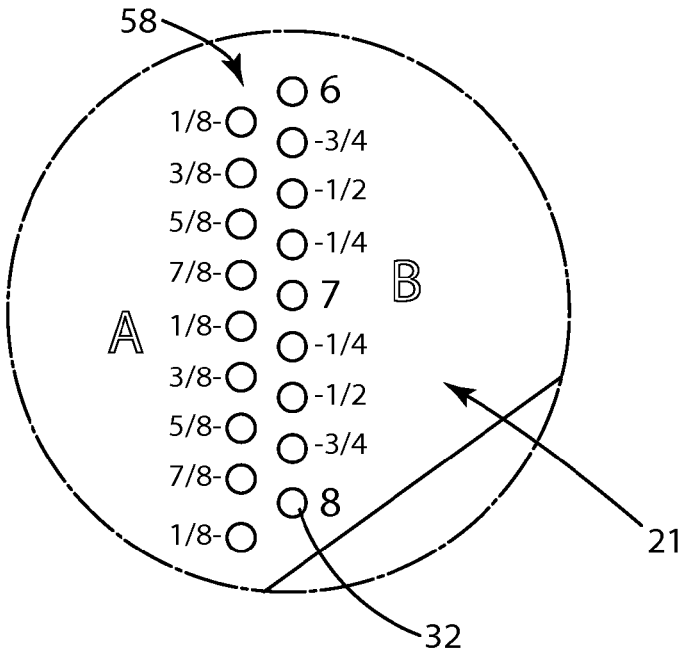
FIG. 6 is a close-up view of the rise indicator holes in the circled portion VI in FIG. 2.

The head bracket 22 additionally includes a rise indicator 21. In the illustrated embodiment, the rise indicator 21 is a plurality of holes 32 defined in the body in two parallel staggered lines 56 and 58. Each staggered line 56, 58 starts proximate to the bottom edge 44 of the bracket 22 and extends toward the top edge 42. As shown in FIG. 6, each rise indicator hole 32 may have a marking positioned next to it to indicate the rise dimension corresponding to the particular hole. In one embodiment, the rise indicator holes 32, and thus the rise indicator markings, are positioned to provide rise dimensions ranging from 6 inches to 8⅛ inches. The holes are staggered in two columns, which may be labeled "A" and "B" respectively. The head bracket may also include a temporary tread support cutout 59 extending through the body 36 and positioned near the top edge 42, but spaced from the top edge 42. As discussed in more detail below, the temporary tread support cutout 59 is sized to receive a temporary tread support 57, such as a conventional 2×4 board. Finally, the head bracket 22 may include additional attachment holes 55 at various locations on the head bracket to receive fasteners such as screws or nails for securing the bracket 22 to the support board 16.

Figure 7:
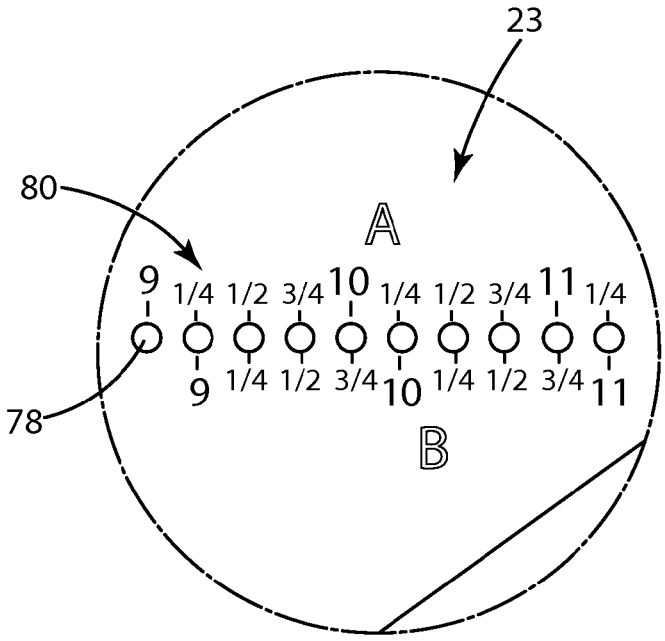
FIG. 7 is a close-up view of the run indicator holes in the circled portion VII in FIG. 3.

Referring now to FIG. 3, in the illustrated embodiment, the center bracket 26 is generally a right triangle in shape, although a variety of shapes are possible. As shown, the center bracket 26 includes a generally planar body 60 having a top edge 62, a front edge 64 and a bottom edge (or hypotenuse) 66. As with the head bracket 22, the center bracket 26 includes a tread flange 68 and a riser flange 70 that are attached to the top 62 and front 64 edges of the bracket 26 as a separate piece. The center bracket 26 additionally includes a rise indicator 21 and a run indicator 23. As shown in FIG. 3, the rise indicator is a plurality of holes 72 defined in the body 60 in two parallel staggered lines 74 and 76. The lines 74, 76 start proximate to the bottom edge 66 and extend generally parallel to the front edge 64. The center bracket 26 may also include the rise indicator markings discussed above in connection with the head bracket 22. The run indicator 23 is a plurality of holes 78 defined in the body 60 in two parallel lines 80 and 82. The lines 80, 82 start proximate to the bottom edge 66 and extend parallel to the top edge 62. As shown in FIG. 7, each run indicator hole 78 may include a marking positioned next to it to indicate the run dimension corresponding to the particular hole. In one embodiment, the run indicator holes 72, and thus the run indicator markings, are positioned to provide run dimensions ranging from 9 inches to 11¼ inches. As shown in FIG. 7, the markings may be located on opposing sides of the holes, with one side labeled "A" and the other side labeled "B." In this embodiment, the markings indicate to the user that if column A is used on the rise indicator 21, then the markings A should be used on the run indicator 23. In one embodiment, the center bracket 26 may also include a temporary tread support cutout 84 that is similar to the temporary tread support cutout 59 in the head bracket 22. The center bracket 26, like the head bracket 22, may also include attachment holes 55.

Referring now to FIG. 4, in one embodiment the foot bracket 24 includes a generally planar body 90 having a top edge 92, a front edge 94, a bottom edge 96 and a rear edge 98. As with the head bracket 22 and center bracket 26, the foot bracket 24 includes a tread flange 100 and a riser flange 102 that are attached to the top 92 and front 94 edges of the bracket 24 as a separate piece. The foot bracket 24 additionally includes a floor flange 106 extending along the bottom edge 96. In the illustrated embodiment, the floor flange is formed from the same piece as the body 90 and is bent generally at a right angle to the body 90.

The foot bracket 24 additionally includes a run indicator 23. As shown in FIG. 4, the run indicator is a plurality of holes 112 defined in the body 90 in two parallel lines 114 and 116. The lines 114, 116 start proximate to the rear edge 98 and extend generally parallel to the top edge 92. The foot bracket 24 may include the run indicator markings discussed above in connection with the center bracket and shown in FIG. 7. In one embodiment, the foot bracket 24 may also include a temporary tread support cutout 118 that is similar to the temporary tread support cutouts 59 and 84 in the head bracket 22 and center bracket 26. The foot bracket 24 may also include attachment holes 55 as in the head bracket 22 and center bracket 26.

Figure 8:
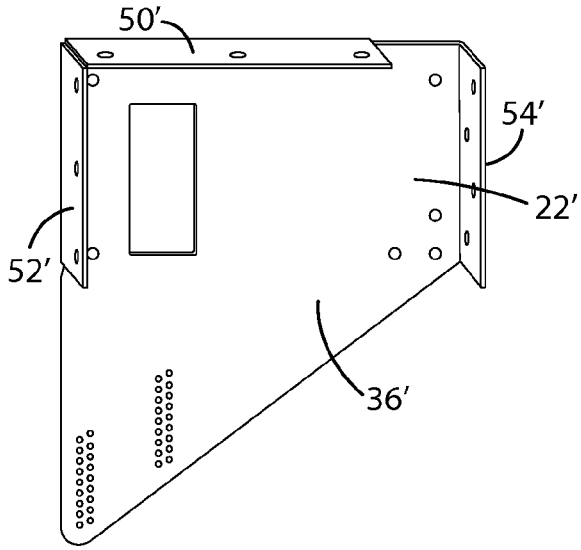
FIG. 8 is a perspective view of a head bracket according to a second embodiment.
Figure 9:
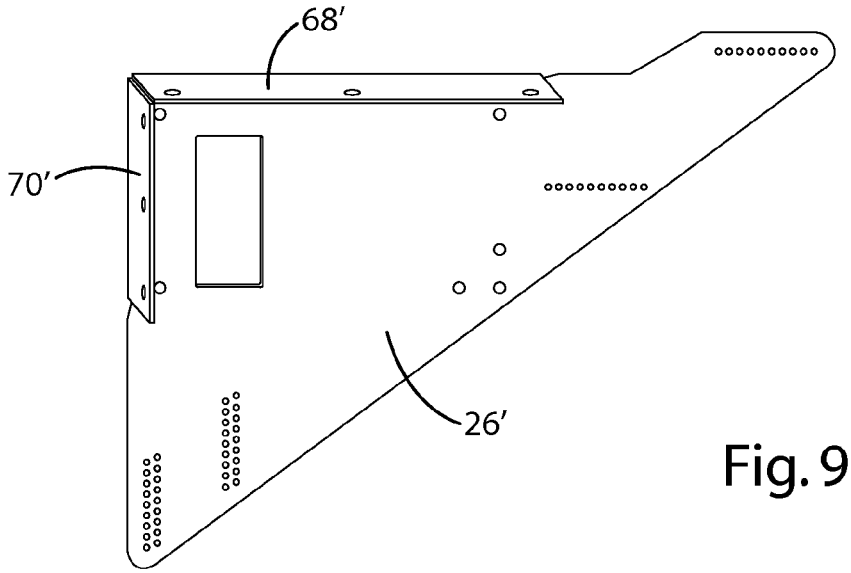
FIG. 9 is a perspective view of a center bracket according to the second embodiment.
Figure 10:
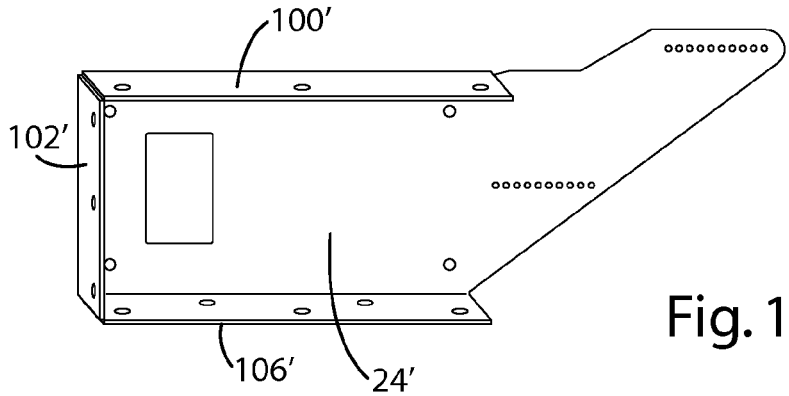
FIG. 10 is a perspective view of a foot bracket according to the second embodiment.
Figure 11:
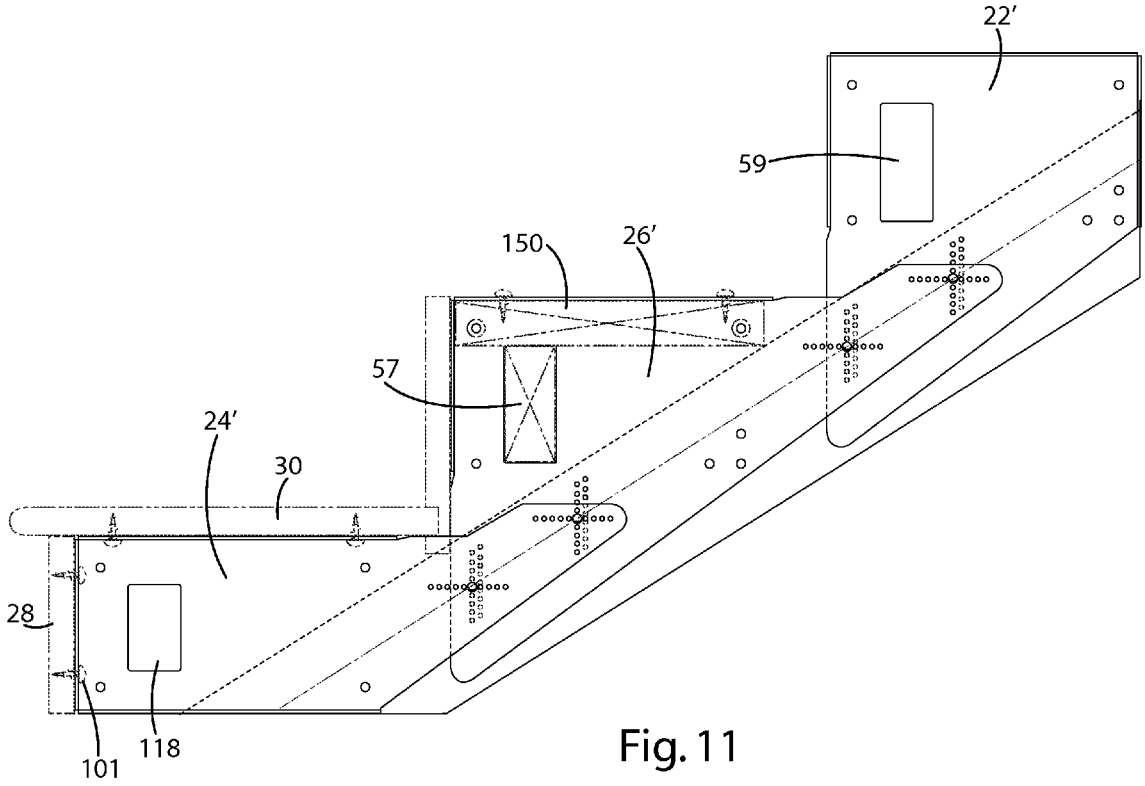
FIG. 11 is a side view of the stringer bracket assembly according to the second embodiment.

FIGS. 8-10 show a second embodiment of the head bracket 22', foot bracket 24' and center bracket 26'. In this embodiment, the brackets 22', 24' and 26' are substantially the same as the first embodiment of the brackets 22, 24 and 26, except that the tread flange 50', riser flange 52' and support flange 54' of the head bracket 22' are all formed with the body 36' as a single piece, by bending the flanges at right angles with the body 36' (in the direction extending out of the page in FIG. 8). Similarly, the tread flange 68' and the riser flange 70' of the center bracket 26', and the tread flange 100', riser flange 102' and floor flange 106' of the foot bracket 24' are bent from the bodies of the center 26' and foot 24' brackets respectively. In one embodiment, the brackets 22', 24' and 26' are all stamped metal products.

Figure 12:
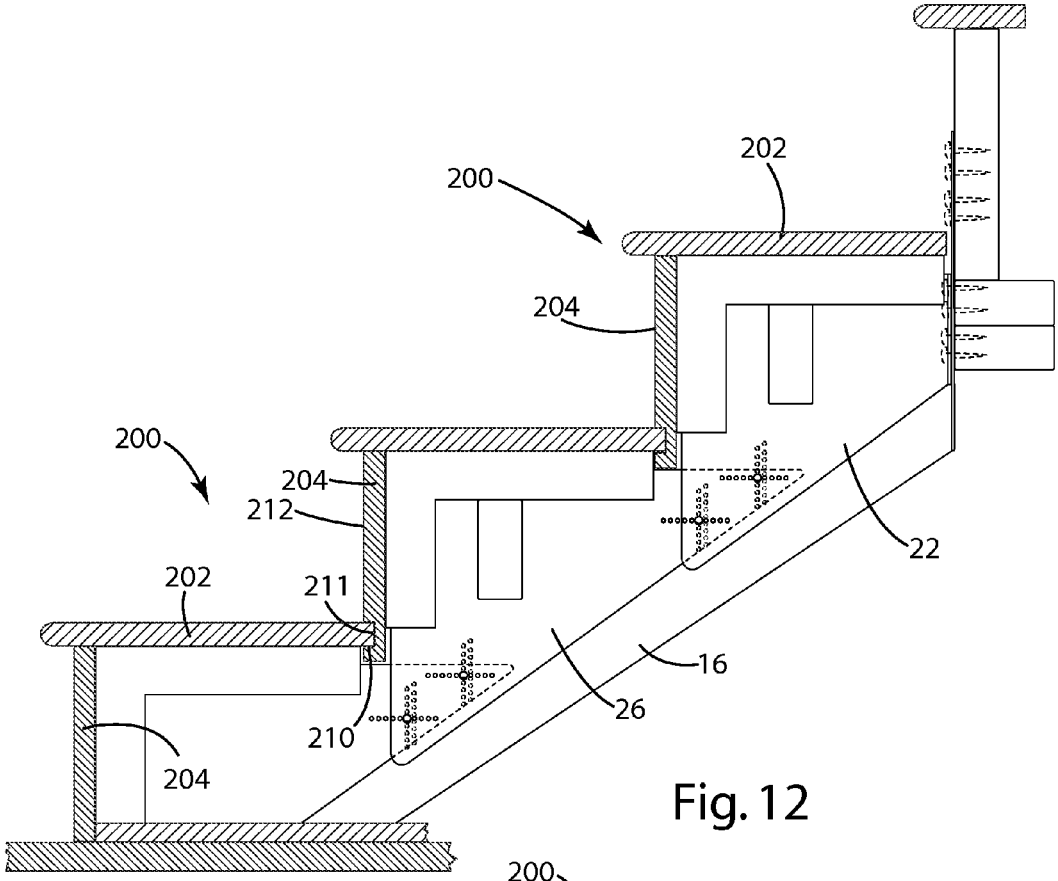
FIG. 12 is a side view of a stringer bracket assembly including a tread/riser combination attached.
Figure 13:
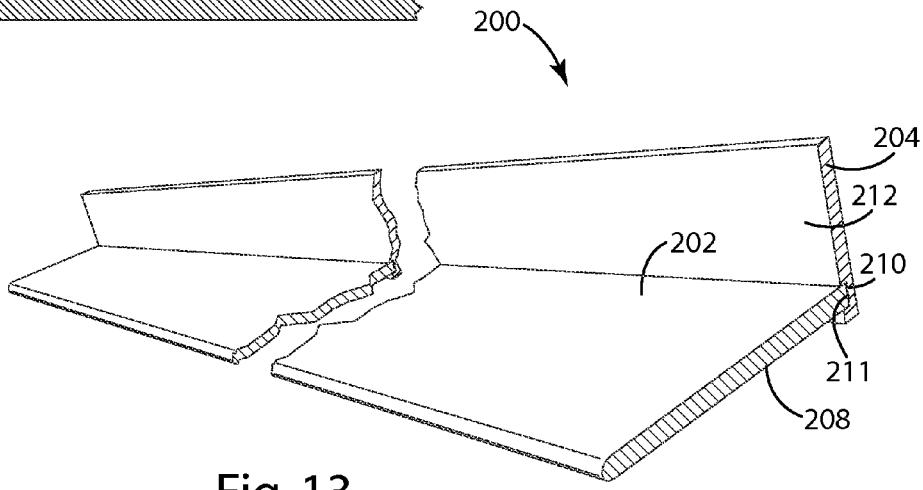
FIG. 13 is a perspective view of a tread/riser combination.

FIG. 12-13 show an embodiment of the present invention including a combination tread and riser product 200. In this embodiment, at least one tread 202 and at least one riser 204 are preassembled before attachment to the stringer assemblies 12, 14. As shown in FIG. 13, in one embodiment, the tread 202 and riser 204 are attached by a rabbit joint, wherein the inner edge 211 of the tread 202 may be inserted into a notch 210 in the front surface 212 of the riser 204. In this embodiment, the preassembled tread and riser combination provides additional structural support for the entire back and underside of the staircase, which may enable construction of staircases with only two stringers. In another embodiment, the treads and risers may be attached in the reverse manner, with a notch in the lower surface 208 of the tread that receives the upper edge 205 of the riser.

III. Assembly

Assembly of the stairway 10 of the illustrated embodiment begins with measuring the distance from the floor 18 to the upper floor structure 20, and then calculating or determining the number of brackets, including a head bracket 22, a foot bracket 24 and one or more center brackets 26, necessary for each stringer assembly 12, 14 to span the distance between the head bracket 22 and foot bracket 24. This division also determines the consistent riser height for all of the brackets 22, 24 and 26. This division may otherwise be determined by a chart that is provided with the assembly 10. The desired run length can be determined from the various run lengths provided in the run indicator markings shown in FIG. 7.

One assembly method of a stringer assembly 12 or 14 begins with marking a scribe line 11 on a support board 16. The scribe line 11 may be a pencil line extending substantially parallel to the longitudinal length of the support board 16. In one embodiment, wherein the support board is a conventional 2×4, the scribe line 11 may be located about 2½ inches from the bottom edge 120 of the board 16. In one embodiment, a center bracket 26 is then attached to the support board 16 using fasteners, such as screws or nails, extending through the attachment holes 55 on the bracket 26 and into the support board 16, while aligning one of the rise indicator holes 72 and one of the run indicator holes 78 with the scribe line 11, so that the bracket 26 is about one foot from the "foot" end 121 of the support board 16.

In one embodiment, a foot bracket 24 is then attached by inserting fasteners through the run indicator holes 112 on the foot bracket 24 corresponding to the predetermined run for the stairway and into the rise indicator holes 72 on the center bracket 26. In the illustrated embodiment (shown in FIG. 5), a first fastener is inserted through a run indicator hole 112 on line 114 and a rise indicator hole 72 on line 74 and into the support board 16 along the scribe line 11, and a second fastener is inserted through a run indicator hole 112 on line 116 and a rise indicator hole 72 on line 76 and into the support board 16 along the scribe line 11. Additional fasteners are inserted through the attachment holes 55 on the foot bracket 24 and into the support board 16 to secure the foot bracket 24 to the support board 16.

The rest of the center panels 26 are then added to the initial center panel 26 by using the rise and run indicator markings to align the run indicator holes 78 of a first center panel 26 with the rise indicator holes 72 of a second center panel 26 and extending fasteners through the aligned holes and into the support board 16 along the scribe line. For instance, one fastener may be inserted through a rise indicator hole 72 on line 74 on a first bracket 26 and through a run indicator hole 78 on line 80 of a second bracket 26, and a second fastener may be inserted through a rise indicator hole 72 on line 76 of the first bracket 26 and through a run indicator hole 78 on line 82 of the second bracket 26. At any point during this process, the stringer assembly can be checked for mistakes by ensuring that each of the fasteners that extends through the aligned indicator holes 72, 78 is also inserted along the scribe line 11 on the support board 16. Each center bracket 26 can be securely attached to the support board 16 by inserting additional fasteners through the attachment holes 55, which helps to transfer loads from the brackets 26 to the support board 16.

The head bracket 22 is aligned on the support board 16 by aligning the rise indicator holes 32 on the head bracket 22 with the run indicator holes 78 on the upper-most center bracket 26. In one embodiment, shown in FIG. 5, one fastener 103 is inserted through one of the rise indicator holes 32 on line 56 and one of the run indicator holes 78 on line 80 and into the support board 16 along the scribe line 11, a second fastener 105 is inserted through one of the run indicator holes 32 on line 58 and one of the run indicator holes 78 on line 82 and into the support board along the scribe line 11. Additional fasteners 107 may be inserted through the attachment holes 55 in the head bracket 22 to further secure the head bracket 22 to the support board 16.

In one embodiment, after the head bracket 22 is secured, the portion of the support board 16 that extends beyond the upper edge 42 of the head bracket 22 can be cut off. Similarly, after the foot bracket 24 is secured to the support board 16, the portion of the support board 16 below the bottom edge 96 of the foot bracket 24 can be cut off.

The assembled stringer assembly 12 or 14 is secured to the ceiling and floor by inserting fasteners through the support flange 54 and into the upper floor structure 20 (i.e. a hanger board, furr blocking or another ceiling support) with the tread flange 50 on the head bracket 22 spaced from the ceiling (not shown) at the predetermined rise distance. The floor flange 106 of the floor bracket 24 is attached to the floor 18, or a furr block (not shown) secured to the floor 18. The above-noted method may be duplicated for the opposite stringer assembly 12, 14 and any additional stringer assemblies. Treads 28 may then be attached to the tread flanges 50, 68 and 100 of the brackets 22, 24 and 26, and risers 30 may be attached to the riser flanges 52, 70 and 102 of the brackets 22, 24 and 26 to complete the stairway assembly. In the bracket embodiment shown in FIGS. 8-11, the treads 28 and risers 30 are attached directly to the tread flanges 50', 70' and 100' and the riser flanges 52', 70' and 102' with conventional fasteners 101.

In another embodiment, wherein the brackets 22, 24 and 26 include temporary tread support cutouts 59, 84 and 118, temporary treads may be installed before installation of the treads 28 and risers 30. In this embodiment (see FIGS. 1 and 11), temporary tread supports 57 are inserted through the cutouts 59, 84 and 118 in each of the stringer assemblies, and temporary treads 150 are attached to the temporary tread supports 57 by conventional fasteners. Support blocks 25 may be attached to the temporary tread supports 57 to provide additional support for the temporary treads 150. The temporary treads 150 may be used throughout the construction project to avoid damaging the finished treads 28 and risers 30, and because the temporary tread support cutouts 58, 84 and 118 and temporary tread supports 57 are spaced from the upper edges 42, 62 and 92 and front edges 38, 64 and 94 of the brackets 22, 24 and 26, the finished treads 39 and risers 28 can be installed without removing the temporary treads 150. Referring to FIG. 1, in one embodiment, the temporary tread supports 57 may enhance the structural support of the stairway assembly by extending beyond the brackets 26 and onto vertical support members 152.

Referring now to FIGS. 12-13, the combination tread and riser product 200 may be attached directly to the tread flanges 50, 70 and 100 and riser flanges 52, 70 and 102. In the tread/riser combination embodiment shown in FIG. 12, including a notch 210 in the front surface 212 of the riser 204, the assembly would begin with the bottom tread 30 (on the foot bracket 24) and proceed up the stairway. One additional tread and riser combination could be split apart to add the bottom-most riser 204 and the top-most tread 202.

Although the above-described assembly method includes a particular order for assembling the stringer assemblies 12, 14 and stairway 10, the assembly does not require a particular order. For instance, the brackets 22, 24 and 26 can be attached to the support board 16 in any order, as long as the rise indicator holes of a first bracket are aligned with the run indicator holes of a second bracket and the scribe line on the support board 16. In addition, alternative run indicators and rise indicators may be used to align the brackets. For instance, the indicators could be elongated slots, dimples, or other markings on the brackets that enable alignment of a particular rise or run dimension on one bracket with a particular rise or run dimension on another bracket. Further, although the illustrated embodiment shows the rise and run indicators being aligned by fasteners, they could otherwise be aligned with alternative alignment elements that align the rise and run indicators but do not extend into the support board.

The above description is that of the current embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property of privilege is claimed are defined as follows:

1. A stringer assembly comprising:

a support element;

a plurality of brackets connected to said support element, each said bracket including a tread attachment portion, each said bracket including a plurality of rise indicator holes, each said rise indicator hole corresponding to a desired rise dimension, each said bracket including a plurality of run indicator holes, each said run indicator hole corresponding to a desired run dimension; and a plurality of alignment elements, each said alignment element interfitted with two of said brackets and said support element, wherein each of said alignment elements is interfitted with one of said rise indicator holes on one of said brackets and one of said run indicator holes on an adjacent one of said brackets, whereby each of said brackets is registered on said support element with respect to said adjacent one of said brackets with said tread attachment portion on said one of said brackets spaced from said tread attachment portion on said adjacent one of said brackets at said desired rise dimension of said one of said rise indicator holes.

2. The stringer assembly of claim 1 wherein said rise indicator holes are generally aligned in a first direction, and wherein said run indicator holes are generally aligned in a second direction different from said first direction.

3. The stringer assembly of claim 2 including a head plate, said head plate connected to said support element, said head plate including one of said rise indicators.

4. The stringer assembly of claim 3 including a foot plate, said foot plate connected to said support element, said foot plate including one of said run indicators.

5. The stringer assembly of claim 1 wherein each bracket includes a riser attachment portion that includes a riser flange and each tread attachment portion includes a tread flange.

6. The stringer assembly of claim 5 wherein at least one of said brackets includes a cutout defined in said at least one bracket, said cutout formed completely within said at least one bracket such that said cutout is completely surrounded by said bracket.

7. The stringer assembly of claim 6 wherein said riser flange and said tread flange are formed with said bracket as a unitary piece.

8. The stringer assembly of claim 6 wherein said riser flange and said tread flange are made from a different material than said bracket and attached to said bracket.

9. The stringer assembly of claim 1 wherein said alignment elements are fasteners, said fasteners each extending through a rise indicator hole on one of said brackets, a run indicator hole on an adjacent one of said brackets and into said support element.

10. A stair assembly comprising:

a support element having a longitudinal length and an edge;

a plurality of brackets, each said bracket including a plurality of rise indicator holes positioned on said bracket, each said rise indicator hole corresponding to a desired rise and a plurality of run indicator holes positioned on said bracket, each said run indicator hole corresponding to a desired run; and a plurality of fasteners, a first said fastener extending through two of said brackets, said first fastener extending through one of said rise indicator holes on a first one of said brackets, one of said run indicator holes on a second one of said brackets and into said support element along said longitudinal length of said support element such that said first fastener is spaced a predetermined distance from said edge of said support element, a second said fastener extending through two of said brackets, said second fastener extending through one of said run indicator holes on said first one of said brackets, one of said rise indicator holes on a third one of said brackets and into said support element such that it is spaced from said first fastener along said longitudinal length of said support element and spaced from said edge at said predetermined distance, wherein said rise indicator holes on said first one of said brackets are spaced from said rise indicator holes on said second one of said brackets and said rise indicator holes on said third one of said brackets at said desired rise, and wherein said run indicator holes on said first one of said brackets are spaced from said run indicator holes on said second one of said brackets and said run indicator holes on said third one of said brackets at said desired run.

11. The stair assembly of claim 10 wherein said brackets each include a riser flange and a tread flange, said rise indicator holes extending in a line generally parallel to said riser flange, said run indicator holes extending in a line generally parallel to said tread flange.

12. The stair assembly of claim 11 including a riser attached to said riser flange, wherein said riser includes a rear surface facing said riser flange and a front surface opposite said rear surface, said front surface defining a notch, said notch receiving a tread attached to said tread flange on said second one of said brackets.

13. The stair assembly of claim 12 wherein at least one of said brackets defines a temporary tread support cutout, the stair assembly including a temporary tread support and a vertical support, said temporary tread extending through said cutout and onto said vertical support.

* * * * *